United States Patent [19]

Ott

[11] 4,243,036

[45] Jan. 6, 1981

[54] AUTOMATIC INJECTING PROJECTILE

[76] Inventor: Peter Ott, Bahnhofstrasse 9, CH-4106 Therwil, Switzerland

[21] Appl. No.: 65,233

[22] Filed: Aug. 9, 1979

[30] Foreign Application Priority Data

Jun. 29, 1979 [CH] Switzerland ..... 6104/79

[51] Int. Cl.[3] ..... A61M 5/00

[52] U.S. Cl. ..... 128/215; 273/418

[58] Field of Search ..... 128/215, 218 R, 216; 273/418

[56] References Cited

U.S. PATENT DOCUMENTS

| | | | |
|---|---|---|---|
| 3,022,785 | 2/1962 | Crockford et al. | 273/418 |
| 4,103,893 | 8/1978 | Walker | 273/418 |
| 4,106,770 | 8/1978 | Gray | 273/418 |

*Primary Examiner*—John D. Yasko

*Attorney, Agent, or Firm*—Ladas & Parry

[57] ABSTRACT

The automatically acting injecting projectile, which may be fired from a rifle or handgun for anesthesia or drug treatment of animals, consists of a casing (9) on one end of which there is a plastic extension (10) and on the other a hollow needle (5). Gas propellant may be filled into pressure chamber (15) of the casing through a check valve (1) and channel (12). Upon impact of the injecting projectile in the body of the animal deformable projectile brake (7) is pushed back and jams on a stopping cone (6). At the same time outlet (5*a*) of hollow needle (5) is cleared by the moving sliding sleeve (8). Thus, piston (2) may be driven by the gas propellant, thereby injecting the drug contained in drug chamber (14) and the hollow needle into the surrounding tissue of the animal through outlet (5*a*).

Charging with the drug before firing is carried out by puncturing a silicon caoutchouc seal (3) with a hypodermic needle through a puncture opening (4) in casing (9), and then injecting the drug into drug chamber (14). After the hypodermic needle is withdrawn the silicon caoutchouc seal (3) will produce a tight seal again.

7 Claims, 3 Drawing Figures

AUTOMATIC INJECTING PROJECTILE

The present invention concerns an automatic injecting projectile to be fired from an anesthesizing rifle or handgun, said projectile having a hollow, cylindrical casing which is subdivided into a pressure chamber and a drug chamber used to hold the drug by a piston sliding within the casing; one end of the casing is equipped with stabilizers and a propellant member and the other end with a hollow needle.

Such automatic injecting projectiles are already known and are used e.g. for the anesthesia or drug treatment of large animals living in the wild or in zoos. In these cases the injecting projectile is fired from a certain distance, and the drug contained in the projectile enters the body of the animal through the hollow needle shortly after impact of the projectile. For example, such an automatic injecting projectile is the subject of Swiss Pat. No. 570 156.

In real life applications of this injecting projectile it has turned out that a.o. it is important to be able to fill the projectile from the outside in a simple fashion and without having to disassemble any parts. Filling the projectile with the drug should take place as close to the firing time as possible, since the drug may show decreased effectiveness after having been stored in the projectile for an extended period of time.

Another problem of the existing injecting projectiles is also the fact that charging of the propellant used to eject the drug is still complicated and time-consuming. Ideally, this propellant too, should be able to be filled by a simple and safe fashion shortly before the injecting projectile is fired.

Thus, it is the goal of the invention presented here to suggest an automatic injecting projectile, which allows the most simple way of filling the propellant shortly before using the projectile, and the design of which also facilitates charging of the drug. The invention solves this task by the combination of characteristics defined in the independent claim.

In the following paragraphs a design example is described using the attached drawing.

Figure 1:
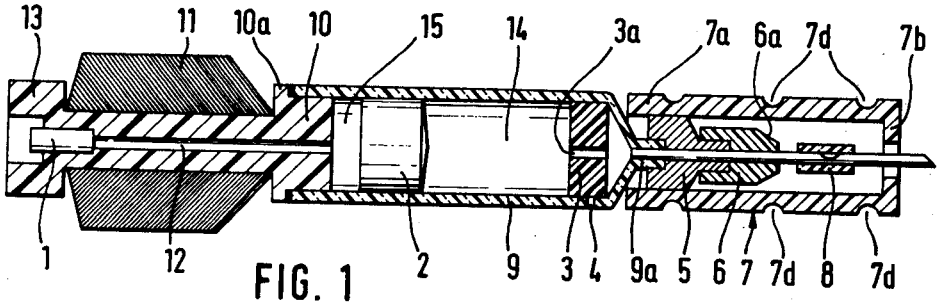

FIG. 1 is a simplified side view of such a design and shows the injecting projectile before its launch.

Figure 2:
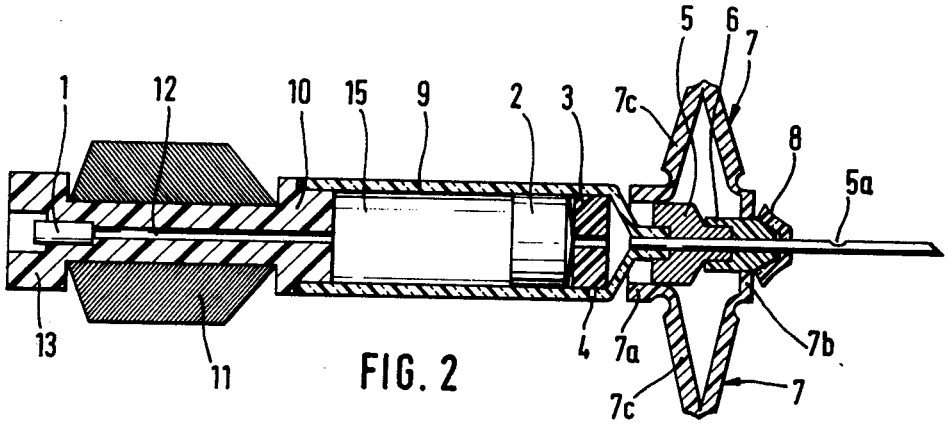
Figure 3:
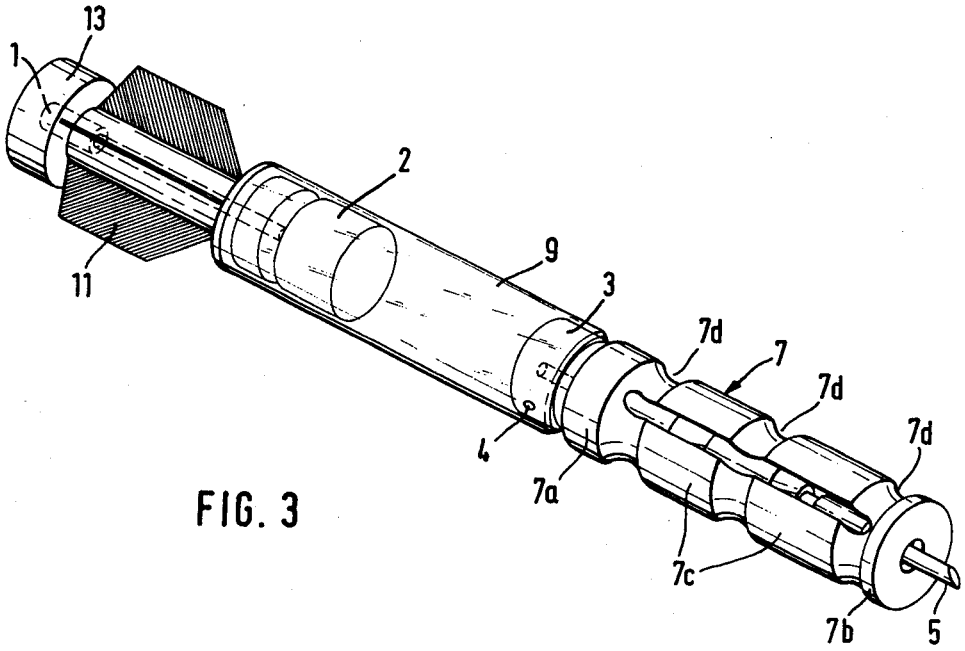

FIG. 2 presents the same design also in a side view, but after the launch i.e. shortly after impact, and FIG. 3 is a perspective view of this injecting projectile.

The selected design example of the automatic injecting projectile shows a hollow, cylindrical casing 9 which is subdivided into a pressure chamber 15 and a drug chamber 14 by a piston 2 which slides within this casing. The extension 10 is braced with a circular shoulder 10*a* at the outer edge of casing 9 and attached to the casing, and on its end away from the casing it is equipped with the propelling member 13. The propelling member 13 has to transmit to the projectile the thrust developed by the cartridge. The propelling member houses a check valve 1 which is connected to the pressure chamber 15 via channel 12. At the outside of the extension 10 stabilizers 11 are attached in the usual fashion.

At the opposite end of the casing 9 the latter is equipped with a hollow needle 5, which may be pushed on to the tapering neck-like front 9*a* of the casing and kept there by friction. The hollow needle 5 has an outlet 5*a* which is normally closed by sliding sleeve 8. Plastic sliding sleeve 8 may be moved along the outside of the hollow needle, but the friction resistance of sliding sleeve 8 on the hollow needle is chosen such that it is moved only by the target after the injecting projectile has impacted.

Furthermore, at the perimeter of hollow needle 5 there is a projectile brake, the whole complex of which is designated as 7. This projectile brake 7 has a circular collar 7*a* as well as a collar 7*b*, also circular, between which there are deformable webs 7*c* coaxial with the longitudinal axis of the hollow needle. The projectile brake 7 is loosely attached to hollow needle 5; however, the diameter of collar 7*a* is preferrably chosen such that there is certain amount of friction between collar 7*a* and the enlarged attachment section of hollow needle 5.

In addition, approximately in the middle of hollow needle 5 there is a stopping cone with a conic stopping surface 6*a*. This stopping cone 6 is stationary due to the friction between itself and the hollow needle 5. Its function will be described in more detail later on.

Furthermore, within the drug chamber 14 there is a silicon caoutchouc seal 3 with a central bore 3*a*. At the perimeter of this silicon caoutchouc seal casing 9 has a puncture opening 4.

If the injecting projectile described is to be fired at a target, first the drug to be administered is filled into drug chamber 14 through puncture opening 4. This is realized by a hypodermic needle with which the silicon caoutchuc seal 3 is punctured in order to charge the drug chamber 14 with the drug through the hypodermic needle. Thus, the drug fills drug chamber 14 and hollow needle 5, but it cannot emerge through outlet 5*a* of the hollow needle, since the latter is still closed by sliding sleeve 8.

Furthermore, before firing the injecting projectile it is necessary to introduce a fluid gas propellant into pressure chamber 15 through check valve 1; said check valve 1 may be designed e.g. as a standard valve used for filling cigarette lighters. Now, the injecting projectile may be fired from a rifle or handgun.

Upon impacting the target hollow needle 5 of the injecting projectile enters the animal body, while projectile brake 7 is pushed back along the axis, thereby being deformed. The circular grooves 7*d* at the perimeter of the projectile brake favor the desired deformation of the projectile brake in the sense that the mid-section of the latter is pushed up according to FIG. 2, while the circular front collar 7*b* is jammed on to the stopping cone 6. Thus, projectile brake 7 slows down the projectile shortly after the latter has entered the body of the animal and stays blocked in the position illustrated in FIG. 2.

However, upon entry of the hollow needle 5 into the body of the animal sliding sleeve 8 on the hollow needle was also moved, from its position according to FIG. 1 into the position according to FIG. 2. As indicated by FIG. 2 the force of the impact pushes sliding sleeve 8 on to stopping cone 6 and clears outlet 5*a*. This results in a rapid pressure decrease within drug chamber 14, and under the influence of the gas propellant contained in pressure chamber 15 piston 2 is moved into the position indicated in FIG. 2, thus injecting the drug through outlet 5*a* of hollow needle 5 into the surrounding tissue of the body of the animal.

The design described above should be regarded as a disposable syringe, i.e. the latter will not be reused.

In one preferred design all parts of the injecting projectile described above, except hollow needle 5 and check valve 1, are made of plastic. Silicon caoutchuc seal 3 may easily be made of another material which is easily punctured and seals itself tightly after the hypodermic needle is withdrawn.

Piston 2 may be equipped with one or more O-rings, and at the perimeter of propelling member 13 there will of course be an O-ring as well, attached in the usual fashion.

Before firing, the injecting projectile described above may be filled from the outside with the desired drug which is injected into the body of the animal at the right moment. The entry depth of the hollow needle is limited directly to the value desired by projectile brake 7.

Charging with the gas propellant is also very simple because of the use of check valve 1 which guarantees an absolutely safe injection.

What I claim is:

1. Automatic injecting projectile to be fired from rifles and handguns, with a hollow, cylindrical casing, separated into a pressure chamber and a chamber containing the drug by a piston sliding loosely within the casing, where one end of the casing is equipped with stabilizers and a propellant, and the other end having a hollow needle, characterized by having a check valve (1) on the end away from the hollow needle (5), said check valve (1) being connected with the pressure chamber (15) of the casing (9) through a channel (12) in order to introduce a fluid gas propellant via the check valve (1) into the pressure chamber (15) before the injecting projectile is fired.

2. Injecting projectile according to claim 1, characterized by the check valve (1) being housed in the propelling member (13).

3. Injecting projectile according to claim 1 or 2, characterized by the hollow needle (5) having a lateral outlet (5*a*) which is closed by a sliding sleeve (8) running on the hollow needle, with the friction resistance of sliding sleeve (8) on the hollow needle (5) being such that upon entry of the hollow needle into the target the sliding sleeve is shifted along its longitudinal axis, thus opening up the outlet (5*a*).

4. Injecting projectile according to claim 1 characterized by having a deformable brake (7) at the hollow needle end of said projectile, said brake (7) being coaxial with the needle.

5. Injecting projectile according to claim 4, characterized by the brake (7) having two collars, one of which (7*a*) being attached to the casing (9) and the other (7*b*) being loosely attached at the circumference of the hollow needle, both collars (7*a*, 7*b*) being interconnected by deformable webs (7*c*).

6. Injecting projectile according to claim 5, characterized by having a stationary stopping cone (6) at the inner end section of the hollow needle (5) in order to block and clamp the collar (7*b*) loosely attached at the circumference of the hollow needle, when said collar (7*b*) is in its rearward position.

7. Injecting projectile according to claim 1, 2, 4, 5 or 6, characterized by having within the drug-containing chamber (14) at its end towards the hollow needle an elastic stopper (3) with an opening (3*a*), and the casing in the area of this stopper (3) having a puncture inlet (4) such that the drug can be injected through the puncture and the elastic stopper into the drug-containing chamber (14).

* * * * *